US009375089B2

(12) United States Patent
Lawson et al.

(10) Patent No.: US 9,375,089 B2
(45) **Date of Patent: *Jun. 28, 2016**

(54) ZERO-WALL CLEARANCE LINKAGE MECHANISM FOR PROVIDING ADDITIONAL LAYOUT

(71) Applicant: L & P PROPERTY MANAGEMENT COMPANY, South Gate, CA (US)

(72) Inventors: Gregory M. Lawson, Tupelo, MS (US); Stephen Lake, Tupelo, MS (US)

(73) Assignee: L & P Property Management Company, South Gate, CA (US)

( * ) Notice: Subject to any disclaimer, the term of this patent is extended or adjusted under 35 U.S.C. 154(b) by 300 days.

This patent is subject to a terminal disclaimer.

(21) Appl. No.: 14/062,500

(22) Filed: Oct. 24, 2013

(65) Prior Publication Data

US 2014/0049079 A1 Feb. 20, 2014

Related U.S. Application Data

(63) Continuation of application No. 12/870,519, filed on Aug. 27, 2010, now Pat. No. 8,573,687.

(51) Int. Cl.
*A47C 1/034* (2006.01)
*A47C 1/0355* (2013.01)

(52) U.S. Cl.
CPC ..... *A47C 1/0342* (2013.01); *A47C 1/0355* (2013.01); *Y10T 74/20594* (2015.01)

(58) Field of Classification Search
CPC ..... A47C 1/0355; A47C 1/0352
USPC ..... 297/75–76, 83–86, 90–91
See application file for complete search history.

(56) References Cited

U.S. PATENT DOCUMENTS

| | | | |
|---|---|---|---|
| 4,071,275 | A | 1/1978 | Rogers, Jr. |
| 4,108,491 | A | 8/1978 | Rogers, Jr. |
| 4,418,957 | A | 12/1983 | Rogers, Jr. |
| 4,740,031 | A | 4/1988 | Rogers |
| 6,729,686 | B2 | 5/2004 | May |
| 7,396,074 | B2 | 7/2008 | Wiecek |

(Continued)

OTHER PUBLICATIONS

Non-Final Office Action dated Feb. 19, 2013 in U.S. Appl. No. 12/870,519, 11 pages.
International Search Report with Written Opinion dated Apr. 14, 2015 in Application No. PCT/US14/62660, 10 pages.
Non-Final Office Action dated Oct. 19, 2015 in U.S. Appl. No. 14/064,700, 9 pages.

*Primary Examiner* — Sarah McPartlin
(74) *Attorney, Agent, or Firm* — Shook, Hardy & Bacon L.L.P.

(57) ABSTRACT

A seating unit that includes a linkage mechanism adapted to adjust between closed, extended, and reclined positions is provided. The linkage mechanism includes a seat-mounting plate mounted to a footrest assembly, a back-mounting link and a rear bellcrank both rotatably coupled to the seat-mounting plate, an activator bar that controls a footrest drive link, and a linear actuator for carrying out automated adjustment of the linkage assembly. In operation, a stroke in a first phase of the linear actuator generates a torque on the activator bar. The footrest drive link converts the torque into a laterally-directed force that pushes the footrest assembly into the extended position. A stroke in the second phase acts to push the activator bar forward and translate the seat-mounting plate forward at a consistent inclination angle. The forward translation causes the rear bellcrank to rotate, thereby biasing the back-mounting link rearward into the reclined position.

12 Claims, 12 Drawing Sheets

(56) References Cited

U.S. PATENT DOCUMENTS

| | | | | |
|---|---|---|---|---|
| 7,850,232 | B2 | 12/2010 | Casteel | |
| 2003/0015893 | A1 | 1/2003 | Hoffman | |
| 2006/0061147 | A1 * | 3/2006 | Johnson | A47C 1/0352 297/85 L |
| 2009/0256402 | A1 * | 10/2009 | Smith | A47C 1/0352 297/69 |
| 2011/0193373 | A1 | 8/2011 | Lawson et al. | |
| 2012/0049606 | A1 | 3/2012 | Lawson et al. | |
| 2012/0235446 | A1 | 9/2012 | Renard et al. | |

* cited by examiner

ZERO-WALL CLEARANCE LINKAGE MECHANISM FOR PROVIDING ADDITIONAL LAYOUT

CROSS-REFERENCE TO RELATED APPLICATIONS

This application is a continuation of U.S. application Ser. No. 12/870,519, which was filed on Aug. 27, 2010, and will issue as U.S. Pat. No. 8,573,687. U.S. application Ser. No. 12/870,519 is incorporated herein by reference in its entirety.

STATEMENT REGARDING FEDERALLY SPONSORED RESEARCH OR DEVELOPMENT

None.

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved linkage mechanism developed to accommodate a wide variety of styling for a seating unit, which is otherwise limited by the configurations of linkage mechanisms in the field. Additionally, the improved linkage mechanism of the present invention provides for reclining a seating unit that is positioned against a wall or placed within close proximity of other fixed objects.

Reclining seating units exist that allow a user to forwardly extend a footrest and to recline a backrest rearward relative to a seat. These existing seating units typically provide three basic positions (e.g., a standard, non-reclined closed position; an extended position; and a reclined position). In the closed position, the seat resides in a generally horizontal orientation and the backrest is disposed substantially upright. Additionally, if the seating unit includes one or more ottomans attached with a mechanical arrangement, the mechanical arrangement is collapsed such that the ottoman(s) are not extended. In the extended position, often referred to as a television ("TV") position, the ottoman(s) are extended forward of the seat, and the backrest remains sufficiently upright to permit comfortable television viewing by an occupant of the seating unit. In the reclined position the backrest is pivoted rearward from the extended position into an obtuse relationship with the seat for lounging or sleeping.

Several modern seating units in the industry are adapted to provide the adjustment capability described above. However, these seating units require relatively complex linkage mechanisms to afford this capability. The complex linkage assemblies limit certain design aspects when incorporating automation. In particular, these linkage assemblies impose constraints on incorporating a single motor for automating adjustment between the positions mentioned above, and require two or more motors to accomplish automation of each adjustment. For instance, achieving a full range of motion when automatically adjusting between positions conventionally requires a plurality of large motors each with a substantial stroke. (The geometry of the linkage assembly prohibits mounting a single large motor thereto without interfering with crossbeams, the underlying surface, or moving parts attached to the linkage assembly.) As such, a more refined linkage mechanism that achieves full movement when being automatically adjusted between the closed, extended, and reclined positions would fill a void in the current field of motion-upholstery technology.

In addition, the lack of lateral adjustment offered by the conventional complex linkage mechanisms disadvantageously requires the entire seating unit to be moved outwardly away from an adjacent wall. Thus, the conventional complex linkage mechanisms require the seating unit to occupy a larger area of a room. Otherwise, without providing substantial clearance between the backrest and the adjacent wall, the backrest in the reclined position will contact the adjacent wall.

Further, when employing motorized adjustment to the conventional complex linkage mechanisms, the seating unit housing these mechanisms is susceptible to tipping forward when adjusted to the reclined position. Tipping is generally caused by an occupant of the seating unit leaning forward while a motor, or other automated mechanism, disallows the collapse of a footrest assembly, which hold the ottoman(s) outward from the seating unit. Accordingly, the occupant is generally obligated to invoke the motorized adjustment when leaning forward in the seating unit to avoid upsetting the seating unit.

Even further, motorized adjustment of the conventional complex linkage mechanisms often causes the ottoman(s) and the backrest of the seating unit to move out of sequence. For example, when adjusting from the closed position to the extended position, a pressure generated by the occupant's legs on the ottoman(s) may cause resistance in extending the footrest assembly. As a result of the resistance, the motorized adjustment may commence reclining the backrest out of sequence until full travel of a predefined stroke is attained.

Accordingly, embodiments of the present invention pertain to a novel linkage mechanism that allows a seating unit to provide a space-saving utility that overcomes the need for considerable wall clearance. Further, the linkage mechanism of the invention is constructed in a simple and refined arrangement in order to provide suitable function while overcoming the above-described, undesirable features inherent within the conventional complex linkage mechanisms.

BRIEF SUMMARY OF THE INVENTION

Embodiments of the present invention seek to provide a simplified linkage mechanism that can be assembled to a compact motor and that can be adapted to essentially any type of seating unit. In an exemplary embodiment, the compact motor in concert with the linkage mechanism can achieve full movement and sequenced adjustment of the seating unit between the closed, extended, and reclined positions. The compact motor may be employed in a proficient and cost-effective manner to adjust the linkage mechanism without creating interference or other disadvantages appearing in the conventional designs that are inherent with automation. The linkage mechanism may be configured with features that assist in preventing tipping of the seating unit, sequencing the seating-unit adjustment between positions, locking a footrest assembly in an extended position, and curing other disadvantages appearing in the conventional designs.

Generally, the novel seating unit includes the following components: first and second foot-support ottomans; a pair of base plates in substantially parallel-spaced relation; a pair of seat-mounting plates in substantially parallel-spaced relation, a seating support surface extending between the seat-mounting plates; and a pair of the generally mirror-image linkage mechanisms that interconnect the base plates to the seat-mounting plates. Additionally, the seat-mounting plates are disposed in an inclined orientation in relation to a surface underlying the seating unit. In operation, the linkage mechanisms are adapted to move between a closed position, an extended position, and a reclined position.

Typically, the linkage mechanisms include a pair of footrest assemblies that movably interconnect the first and second foot-support ottomans to the seat-mounting plates. In instances, the linkage mechanisms each include a seat-adjustment assembly with a rear bellcrank that is adapted to translate the respective seat-mounting plates over the base plates during adjustment between the closed position, the extended position, and the reclined position. In embodiments, the rear bellcrank translates a respective seat-mounting plate while maintaining the seat-mounting plate's inclined orientation relationship to the base plates. As such, the seating support surface may be biased at a particular inclination angle throughout adjustment.

In another embodiment, each of the linkage mechanisms include a sequence plate and a sequence element. The sequence plate includes a guide slot that is configured with a first region, a second region, and an intermediate region that interconnects the first region and the second region. The sequence element generally extends into the guide slot. In operation, the sequence element resides within the first region when the seating unit is adjusted to the reclined position, within the intermediate region when the seating unit is adjusted to the extended position, and within the second region when the seating unit is adjusted to the closed position. As such, when moving from the closed position to the extended position, the backrest is restrained from inadvertently reclining. Also, when moving from the reclined position to the extended position, the footrest assembly is restrained from inadvertently extending.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
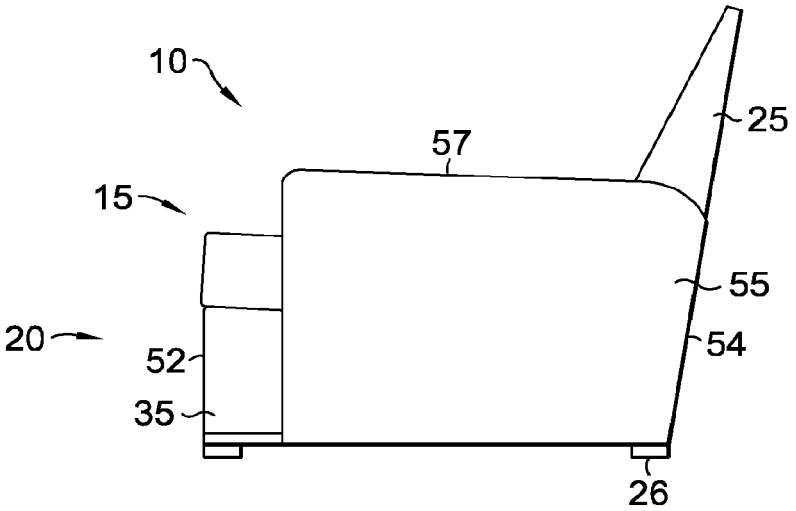
FIG. 1 is a diagrammatic lateral view of a seating unit in a closed position, in accordance with an embodiment of the present invention.
Figure 2:
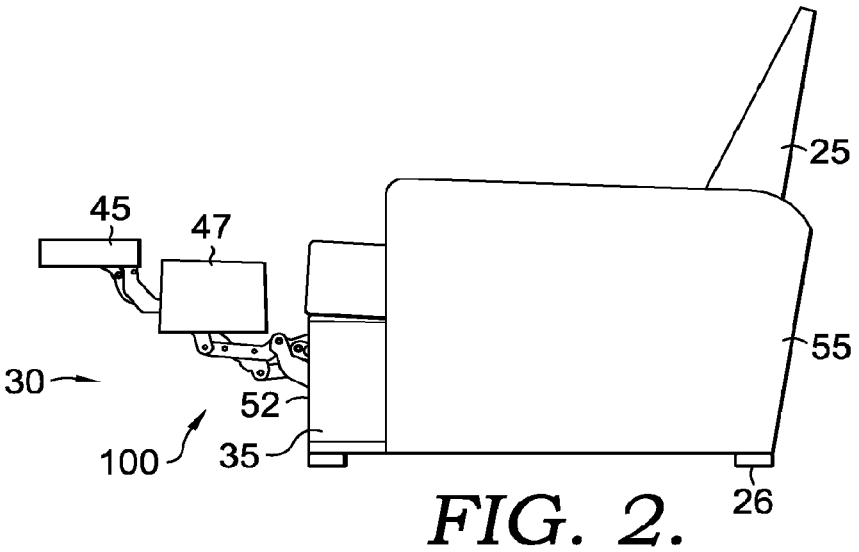
FIG. 2 is a view similar to FIG. 1, but in an extended position, in accordance with an embodiment of the present invention.
Figure 3:
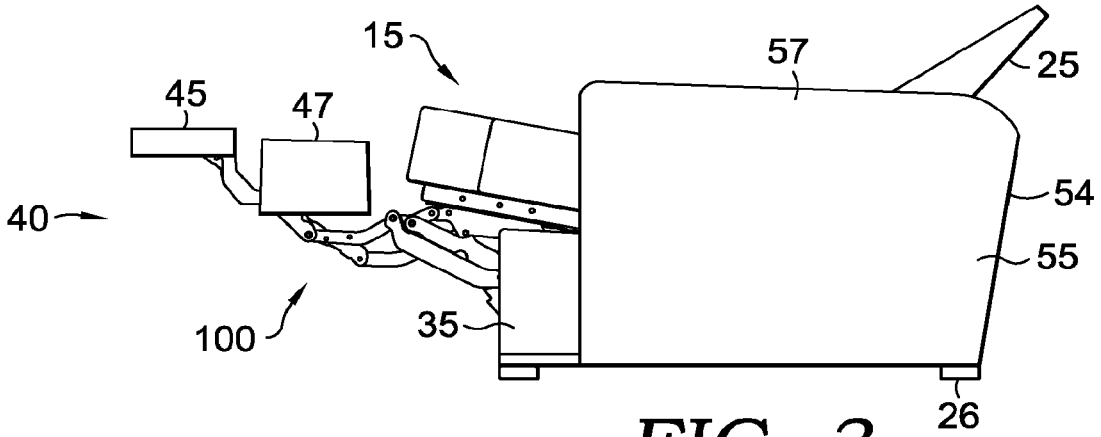
FIG. 3 is a view similar to FIG. 1, but in a reclined position with opposed arms attached to a stationary base, in accordance with an embodiment of the present invention.

FIGS. 1-3 illustrate a seating unit 10. Seating unit 10 has a seat 15, a backrest 25, legs 26 (e.g., support bushings 411 and 412 of FIGS. 5 and 15), a linkage mechanism 100, a first foot-support ottoman 45, a second foot-support ottoman 47, a stationary base 35, and a pair of opposed arms 55. Stationary base 35 has a forward section 52, a rearward section 54, and is supported by the legs 26, where the legs 26 support the stationary base 35 and raise it above an underlying surface (not shown). In addition, the stationary base 35 is interconnected to the seat 15 via the linkage mechanism 100 that is generally disposed between the pair of opposed arms 55, and the rearward section 54. Seat 15 is moveable over the stationary base 35 during adjustment of the seating unit 10. In embodiments, the seat 15 is moveable according to the arrangement of the linkage mechanism 100 such that no portion of the seat 15 interferes with the opposed arms 55 throughout adjustment.

Opposed arms 55 are laterally spaced and have an arm-support surface 57 that is substantially horizontal. In one embodiment, the pair of opposed arms 55 are attached to the stationary base via intervening members, as illustrated in FIG. 3. The backrest 25 extends from the rearward section 54 of the stationary base 35 and is rotatably coupled to the linkage mechanism 100, typically proximate to the arm-support surface 57. First foot-support ottoman 45 and the second foot-support ottoman 47 are moveably supported by the linkage mechanism 100. The linkage mechanism 100 is arranged to articulably actuate and control movement of the seat 15, the back 25, and the ottomans 45 and 47 between the positions shown in FIGS. 1-3, as more fully described below.

As shown in FIGS. 1-3, the seating unit 10 is adjustable to three basic positions: a closed position 20, an extended position 30 (i.e., TV position), and the reclined position 40. FIG. 1 depicts the seating unit 10 adjusted to the closed position 20, which is a normal non-reclined sitting position with the seat 15 in a generally horizontal position and the back 25 generally upright and in a substantial perpendicular biased relation to the seat 15. In particular, the seat 15 is disposed in a slightly inclined orientation relative to the stationary base 35. In this embodiment, the inclined orientation may be maintained throughout adjustment of the seating unit 10. In addition, when adjusted to the closed position 20, the ottomans 45 and 47 are positioned below the seat 15.

Turning to FIG. 2, the extended position 30, or TV position, will now be described. When the seating unit 10 is adjusted to the extended position, the first foot-support ottoman 45 and the second foot-support ottoman 47 are extended forward of the forward section 52 of the stationary base 35 and disposed generally horizontal. However, the backrest 25 remains substantially perpendicular to the seat 15 and will not encroach an adjacent wall. Also, the seat 15 is maintained in the inclined orientation relative to the stationary base 35. Thus, the configuration of the seating unit 10 in the extended position 30 provides an occupant a reclined TV position while providing space-saving utility. Typically, the seat 15 is translated slightly forward and upward relative stationary base 35. This independent movement of the seat 15 allows for a variety of styling to be incorporated into the seat 15, such as T-cushion styling.

FIG. 3 depicts the reclined position 40, in which the seating unit 10 is fully reclined. With reference to FIG. 3, the opposed arms 55 are attached to the stationary base 35. In another embodiment, the legs 26 may extend from the downward linkage mechanism 100, instead of being attached to the stationary base 35. The backrest 25 is rotated rearward by the linkage mechanism 100 and biased in a rearward inclination angle. The rearward inclination angle is typically an obtuse angle in relation to the seat 15. However, the rearward inclination angle of the backrest 25 is offset by a forward and upward translation of the seat 15 as controlled by the linkage mechanism 100. This is in contrast to other reclining chairs with 3-position mechanisms, which cause their backrest to move rearward during adjustment, thereby requiring that the reclining chair be positioned a considerable distance from an adjacent rear wall or other proximate fixed objects. Thus, the forward and upward translation of the seat 15 in embodiments of the present invention allow for zero-wall clearance. Generally, the "zero-wall clearance" is utilized herein to refer to space-saving utility that permits positioning the seating unit 10 in close proximity to an adjacent rear wall and other fixed objects. In embodiments of the reclined position 40, the ottomans 45 and 47 may be moved farther forward and upward from their position in the extended position 30.

Figure 5:
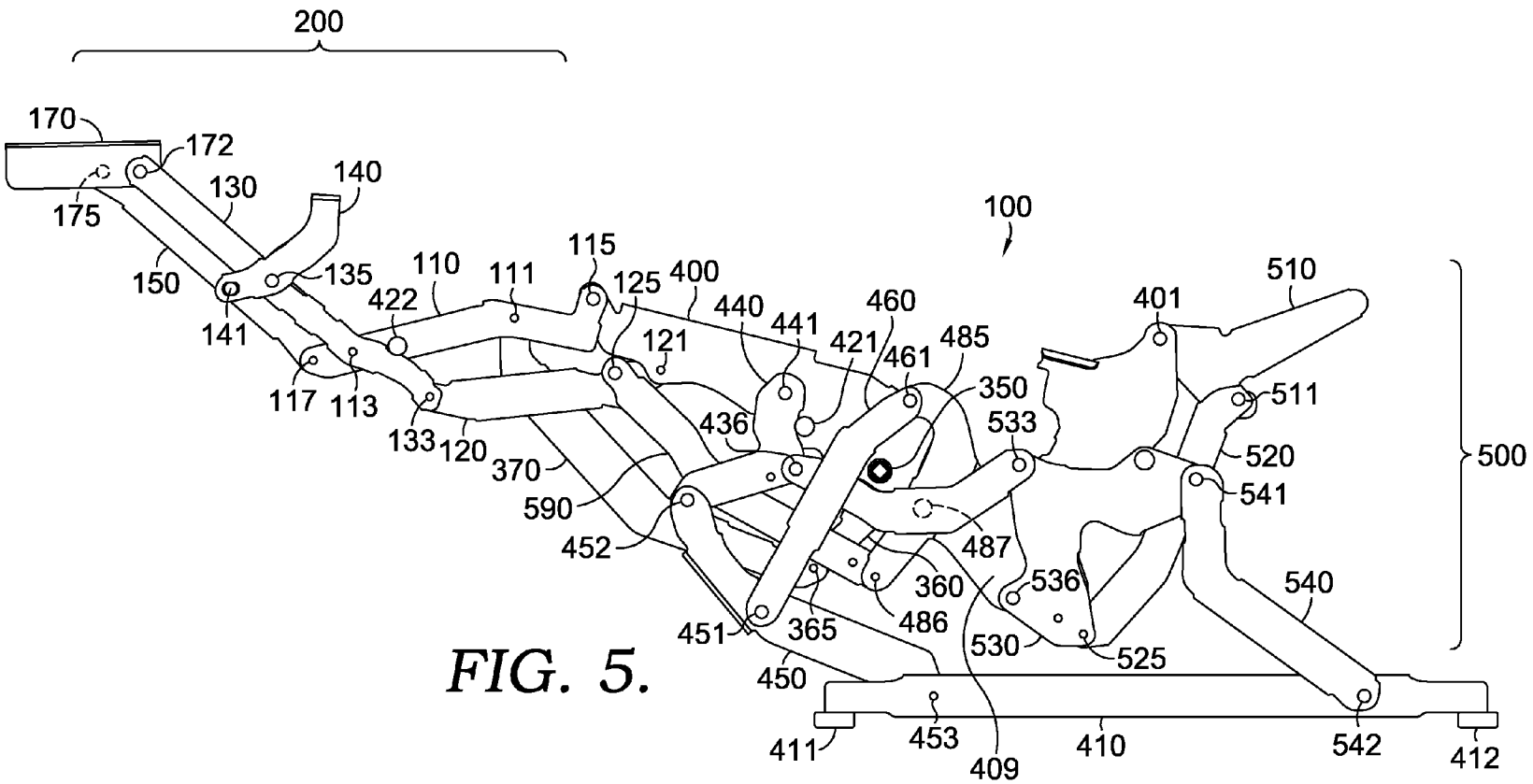
FIG. 5 is a diagrammatic lateral view of the linkage mechanism in the reclined position from a vantage point internal to the seating unit, in accordance with an embodiment of the present invention.
Figure 6:
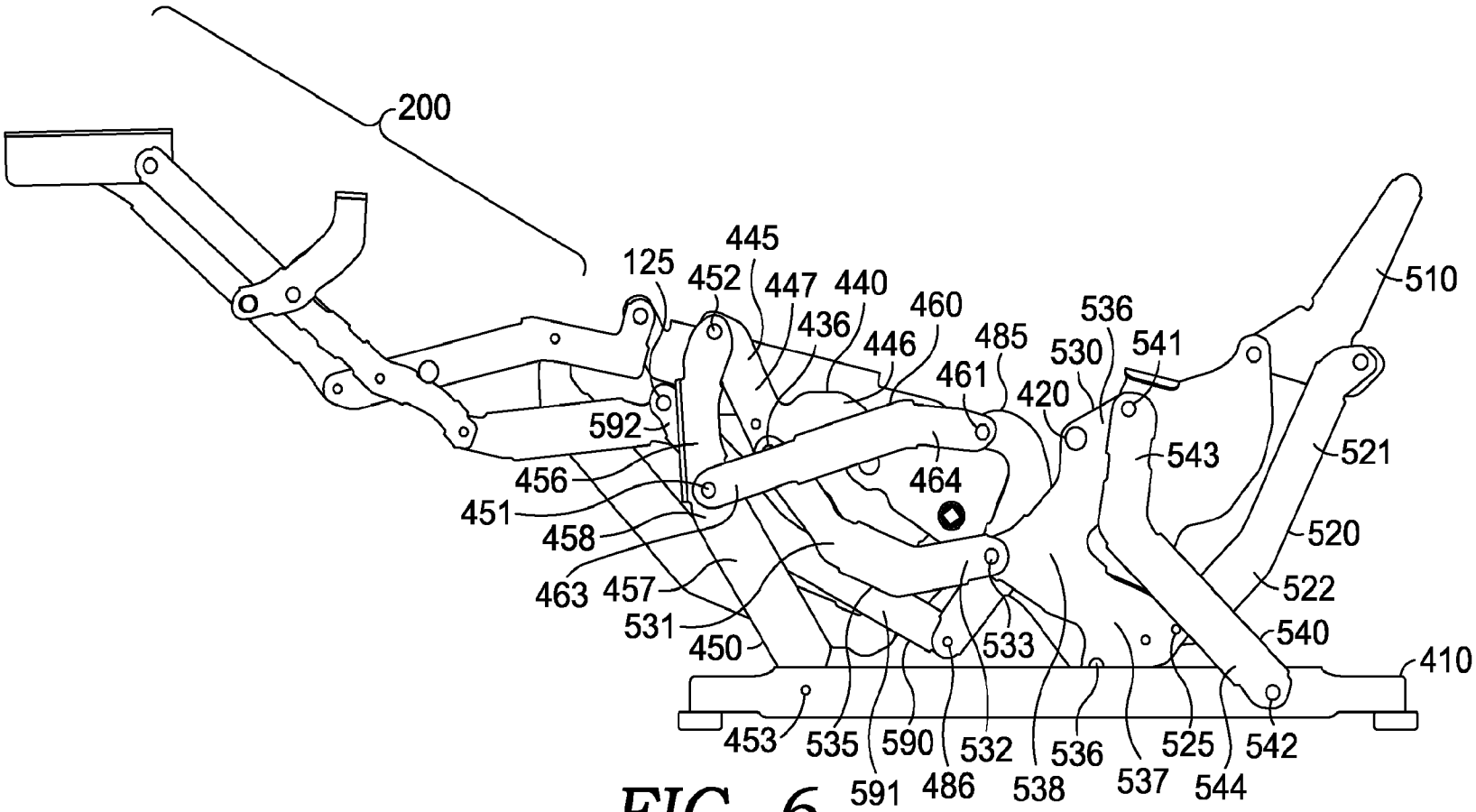
FIG. 6 is a view similar to FIG. 5, but in the extended position, in accordance with an embodiment of the present invention.
Figure 7:
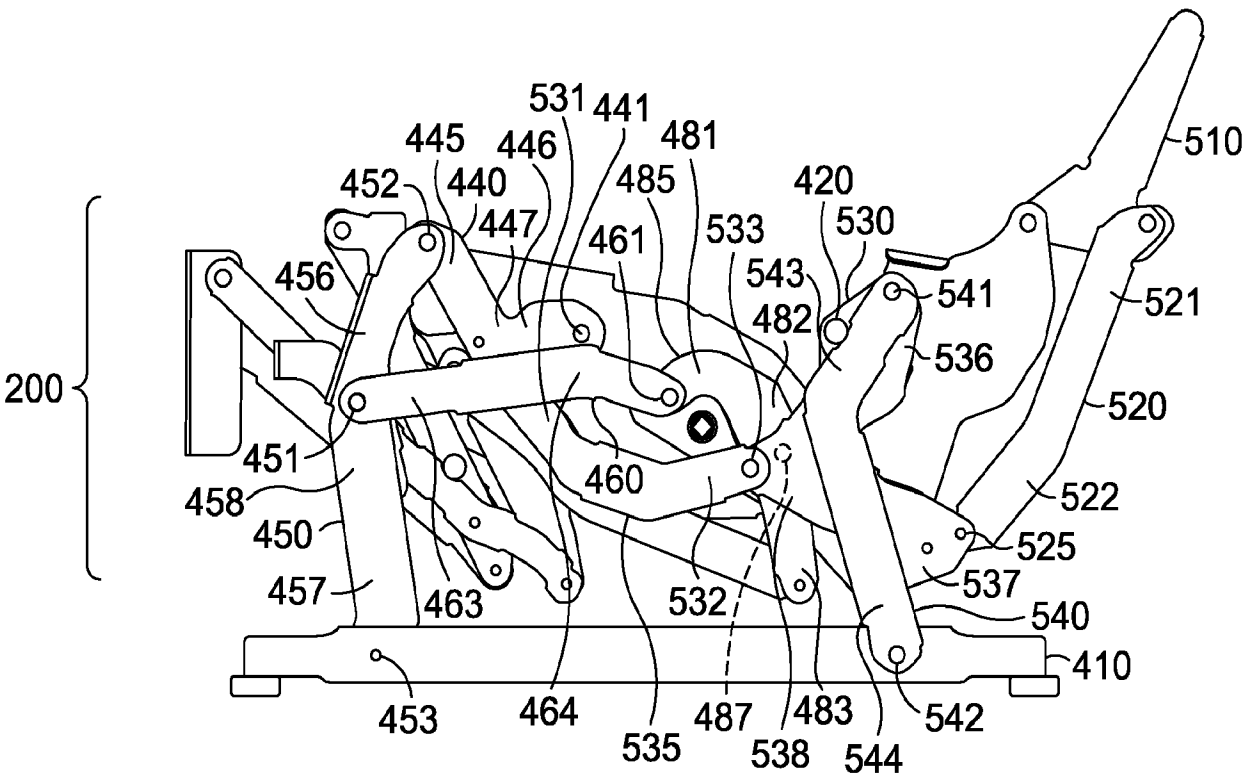
FIG. 7 is a view similar to FIG. 5, but in the closed position, in accordance with an embodiment of the present invention.

FIGS. 4-7 illustrate the configuration of the linkage mechanism 100 for a manually adjustable, zero-wall clearance, seating unit 10 (hereinafter the "seating unit") that is designed to provide additional layout when adjusted to the reclined position. As discussed above, the linkage mechanism 100 is arranged to articulably actuate and control movement of a seat, a backrest, and ottoman(s) of the recliner between the positions shown in FIGS. 4-7. That is, the linkage mechanism 100 is adjustable to a reclined position (FIGS. 4 and 5), an extended (TV) position (FIG. 6), and a closed position (FIG. 7). In the reclined position, the backrest is rotated rearward and biased in a rearward inclination angle, which is an obtuse angle in relation to the seat. When the recliner is manually adjusted to the extended position, the ottoman(s) remain extended forward, while the backrest is angularly biased substantially perpendicular to the seat. The closed position is configured as a non-reclined sitting position with the seat in a generally horizontal position and the backrest remaining generally upright. During adjustment between the closed, extended, and reclined positions, the linkage mechanism 100 includes a seat-adjustment assembly 500 with a rear bellcrank 530 that is adapted to translate a pair of seat-mounting plates 400 over respective base plates 410 in a consistent inclined orientation relative to the base plates 410.

Further, the linkage mechanism 100 comprises a plurality of other linkages that are arranged to actuate and control movement of the seating unit during movement between the closed, the extended, and the reclined positions. These linkages may be pivotably interconnected. It is understood and appreciated that the pivotable couplings (illustrated as pivot points in the figures) between these linkages can take a variety of configurations, such as pivot pins, bearings, traditional mounting hardware, rivets, bolt and nut combinations, or any other suitable fasteners which are well-known in the furniture-manufacturing industry. Further, the shapes of the linkages and the brackets may vary, as may the locations of certain pivot points. It will be understood that when a linkage is referred to as being pivotably "coupled" to, "interconnected" with, "attached" on, etc., another element (e.g., linkage, bracket, frame, and the like), it is contemplated that the linkage and elements may be in direct contact with each other, or other elements, such as intervening elements, may also be present.

Generally, the linkage mechanism 100 guides the rotational movement of the backrest, the seat, and the ottoman(s). In an exemplary configuration, these movements are controlled by a pair of essentially mirror-image linkage mechanisms (one of which is shown herein and indicated by reference numeral 100), which comprise an arrangement of pivotably interconnected linkages. The linkage mechanisms are disposed in opposing-facing relation about a longitudinally-extending plane that bisects the recliner between the pair of opposed arms. As such, the ensuing discussion will focus on only one of the linkage mechanisms 100, with the content being equally applied to the other complimentary linkage assembly.

Figure 4:
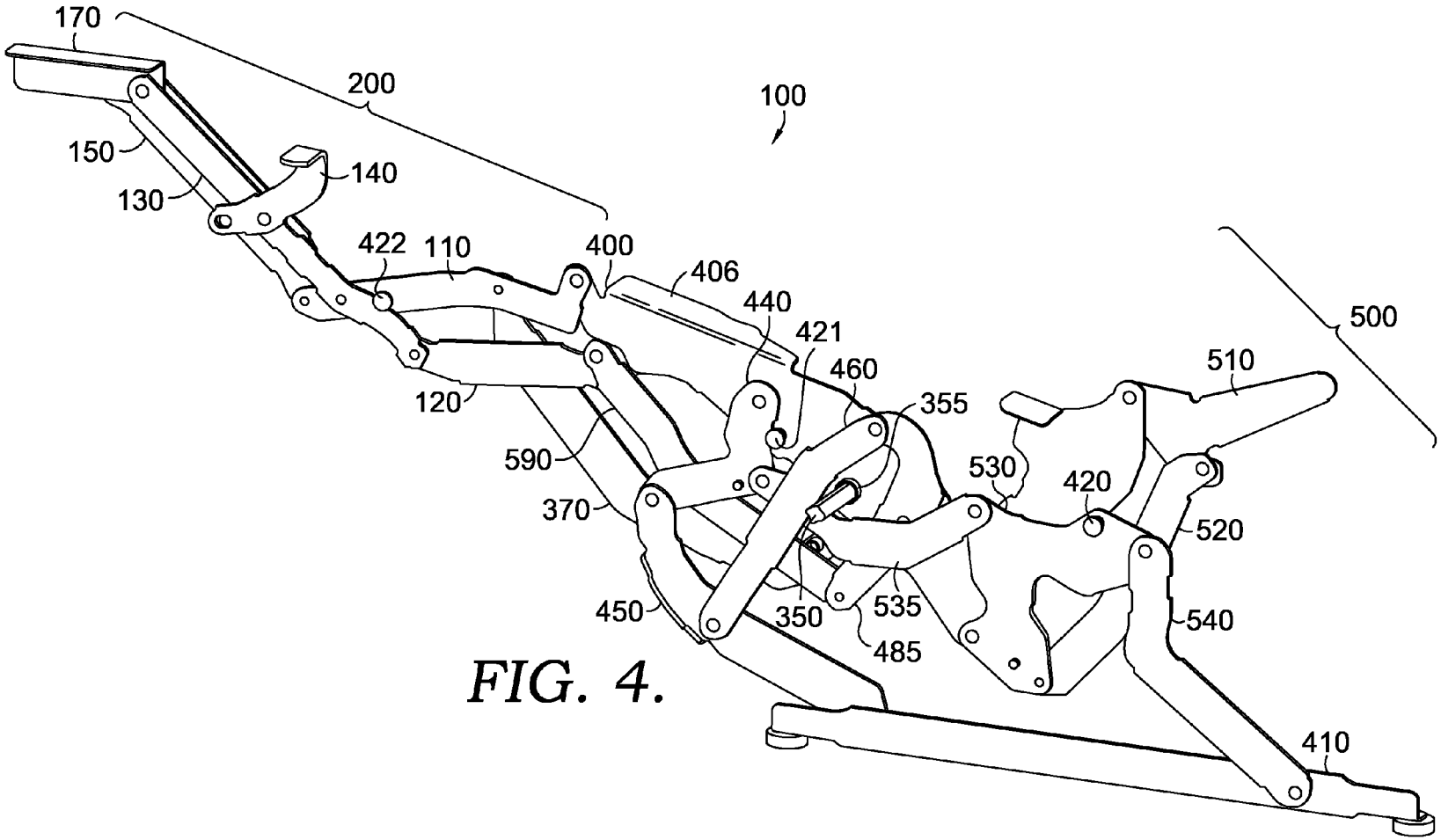
FIG. 4 is a perspective view of a linkage mechanism in the reclined position, in accordance with an embodiment of the present invention.

With continued reference to FIG. 4, a partial perspective view of the linkage mechanism 100 in the reclined position is shown, in accordance with an embodiment of the present invention. In embodiments, the linkage mechanism 100 includes a footrest assembly 200, the seat-mounting plate 400, the base plate 410, and a seat-adjustment assembly 500. Footrest assembly 200 is comprised of a plurality of links arranged to extend and collapse the ottoman(s) during adjustment of the recliner from the extended position to the closed position, respectively. Seat-mounting plate 400 is configured to fixedly mount to the seat, and, in conjunction with an opposed seat-mounting plate, define a seat support surface (not shown). Seat-adjustment assembly 500 includes a back-mounting link 510, the rear bellcrank 530, a sequence link 550 (see FIGS. 11-14), and a plurality of other links. Generally, the seat-adjustment assembly 500 is adapted to recline and incline the backrest, which is coupled to the back-mounting link 510, and to laterally translate the seat, which is coupled to the seat-mounting plate 400.

With reference to FIGS. 4-7, the components of the linkage mechanism 100 will now be discussed in detail. As briefly mentioned above, the linkage mechanism 100 includes the footrest assembly 200, the seat-mounting plate 400, the base plate 410, and the seat-adjustment assembly 500. The footrest assembly 200 includes a front ottoman link 110, a rear ottoman link 120, an outer ottoman link 130, a mid-ottoman bracket 140, an inner ottoman link 150, and a footrest bracket 170. Front ottoman link 110 is rotatably coupled to the seat-mounting plate 400 at pivot 115. The front ottoman link 110 is pivotably coupled to the outer ottoman link 130 at pivot 113 and the inner ottoman link 150 at pivot 117. Further, the front ottoman link 110 includes a front stop element 422 for ceasing adjustment from the closed position to the extended position upon the outer ottoman link 130 making contact therewith.

The front ottoman link 110 is also pivotably coupled to a footrest lock link 370 at pivot 111. Footrest lock link 370 is indirectly coupled with the activator bar 350 via an activator bracket 360, where the activator bar 350 is manually or automatically rotated to control the extension or the collapse of the footrest assembly 200. As illustrated in FIG. 5, the pivotable coupling 111 between the footrest lock link 370 and the front ottoman link 110, as opposed to the rear ottoman link 120, provides an over-center locking configuration that reduces slack or drooping of the footrest assembly 200 when in the closed position. In other words, the pivotable coupling 111 of the footrest lock link 370 is located forward of a comparable pivot-connection location in other mechanisms. This forward location of pivot 111 removes potential slack contributors within the links behind the footrest assembly 200. Accordingly, the forward location of the pivot 111 that couples the footrest lock link 370 to the footrest assembly 200 firmly holds the ottomans attached to the mid-ottoman bracket 140 and the footrest bracket 170, respectively, upward and inward to the chassis of the seating unit in the closed position.

Rear ottoman link 120 is rotatably coupled to the seat-mounting plate 400 at pivot 121 and pivotably coupled to the inner ottoman link 130 at pivot 133. Further, the rear ottoman link 120 is pivotably coupled to a footrest drive link 590, of the seat-adjustment assembly 500, at pivot 125. During adjustment between the closed and extended positions, a forward directional force transferred by the footrest drive link 590 to the pivot 125 causes the footrest assembly 200 to push out to the extended position.

Inner ottoman link 130 is pivotably coupled on one end to the rear ottoman link 120 at the pivot 133 and the front ottoman link 110 at the pivot 113. At an opposite end, the inner ottoman link 130 is pivotably coupled to the footrest bracket 170 at pivot 172. Between the ends of the inner ottoman link 130, the mid-ottoman bracket 140 is pivotably coupled thereto at pivot 135. Mid-ottoman bracket 140 is also pivotably coupled to the outer ottoman link 150 at pivot 141. Outer ottoman link 150 is further pivotably coupled to the front ottoman link 110 at the pivot 117 and to the footrest bracket 170 at pivot 175.

Figure 8:
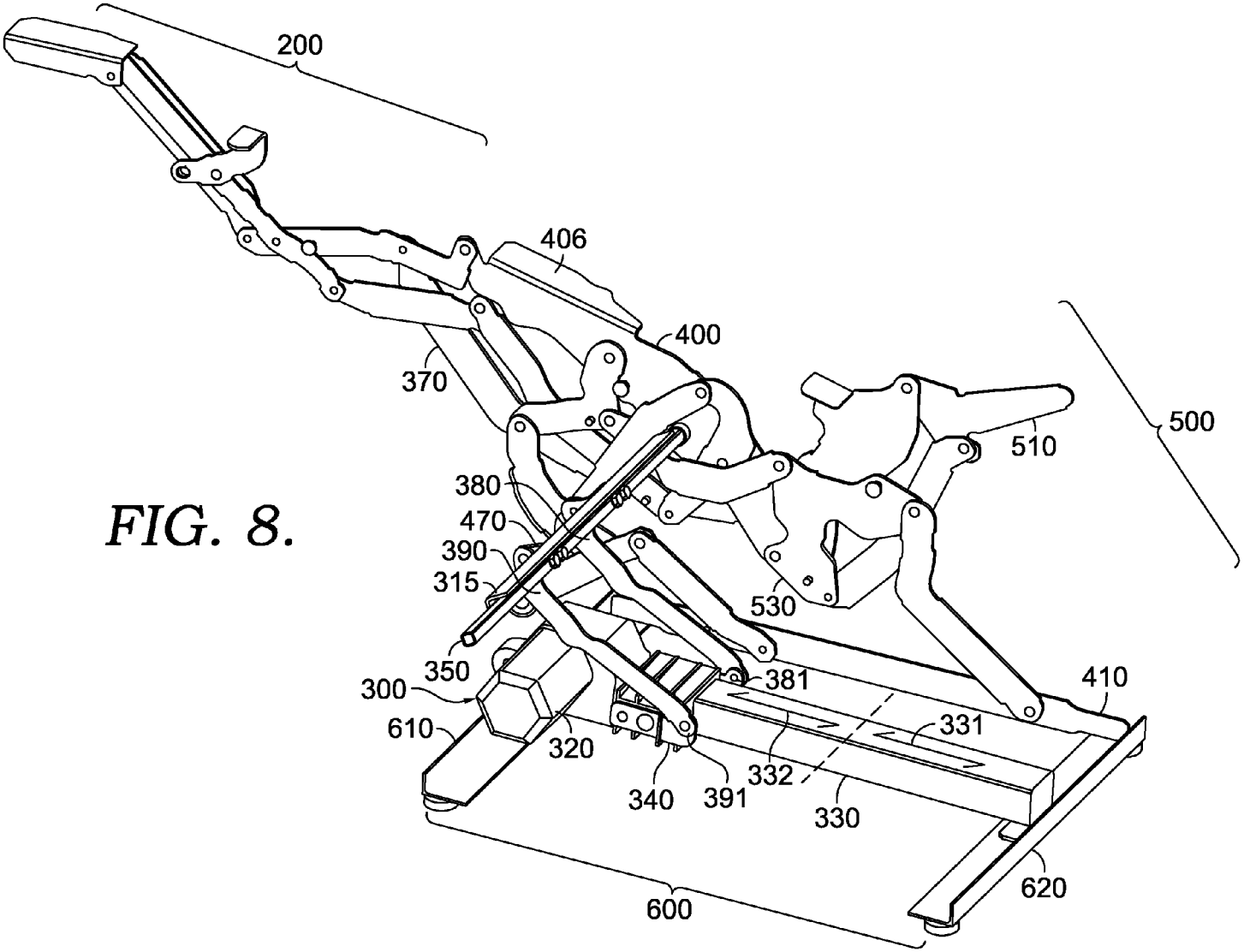
FIG. 8 is a perspective view of the linkage mechanism in the reclined position illustrating a linear actuator for providing motorized adjustment of the seating unit, in accordance with an embodiment of the present invention

Seat-adjustment assembly 500 includes the activator bracket 360, the footrest lock link 370, a front lift link 440, a front pivot link 450, a carrier link 460, the motor swing bracket 470, motor drive links 380 and 390, a front bellcrank 485, a back-mounting link 510, a rear control link 520, the rear bellcrank 530, a bridge link 535, a rear pivot link 540, the sequence plate 550 that has a guide slot 555 formed therein, a sequence element 560 that travels within the guide slot 555, a front sequence link 570, and the footrest drive link 590. As discussed above, with reference to FIGS. 5 and 11, the activator bar 350 is rotatably coupled to the seat-mounting plate 400. Generally, the activator bar 350 spans the chassis of the seating unit, as shown in FIG. 8, and rotatably couples with a complimentary base plate of a mirror-image linkage mechanism as well.

Figure 11:
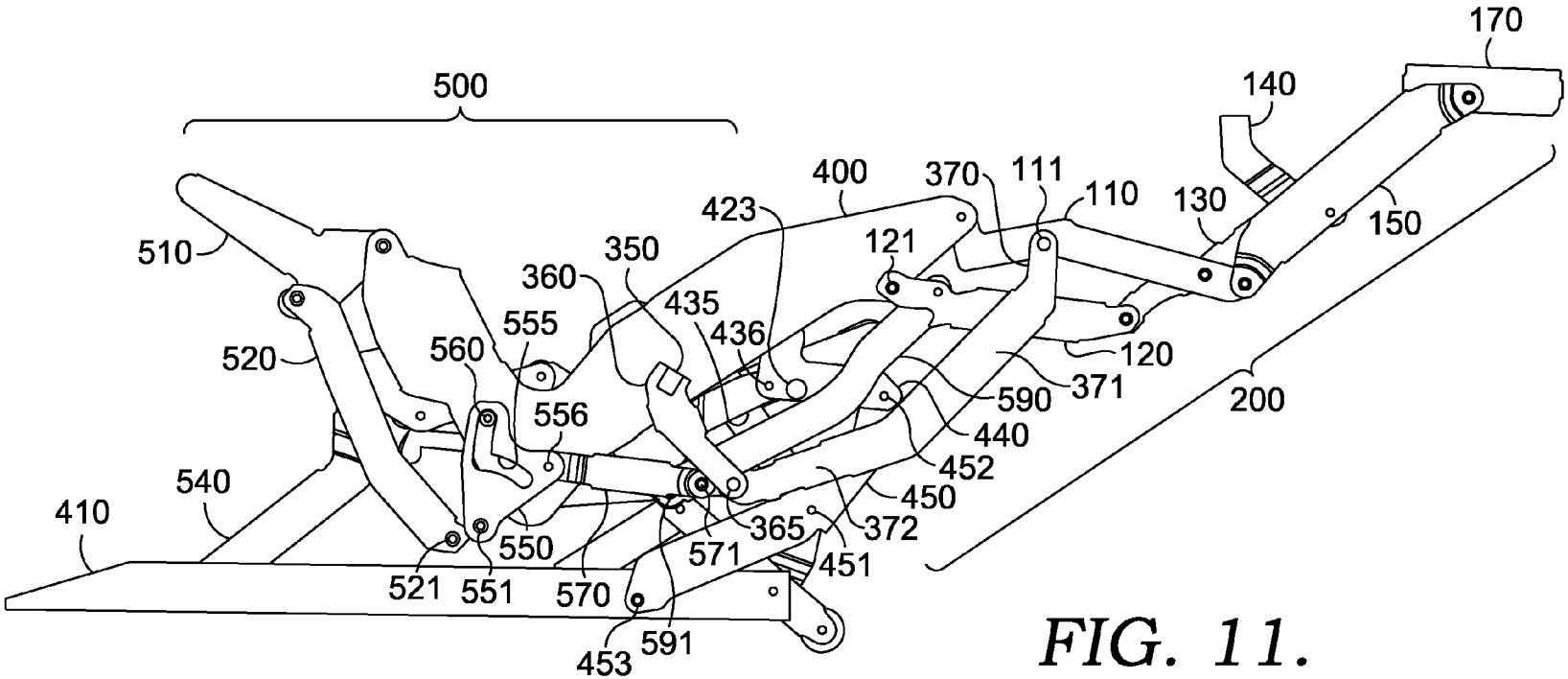
FIG. 11 is a diagrammatic lateral view of the linkage mechanism in the reclined position from a vantage point external to the seating unit, in accordance with an embodiment of the present invention.
Figure 13:
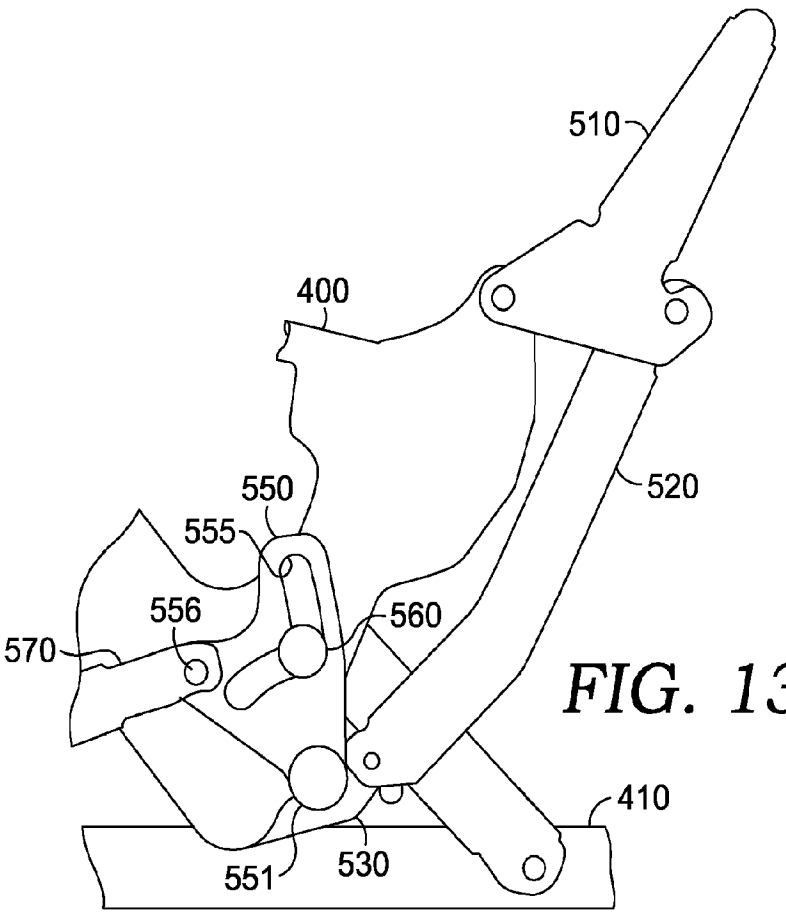
FIG. 13 is a view similar to FIG. 12, but in the extended position, in accordance with an embodiment of the present invention.
Figure 12:
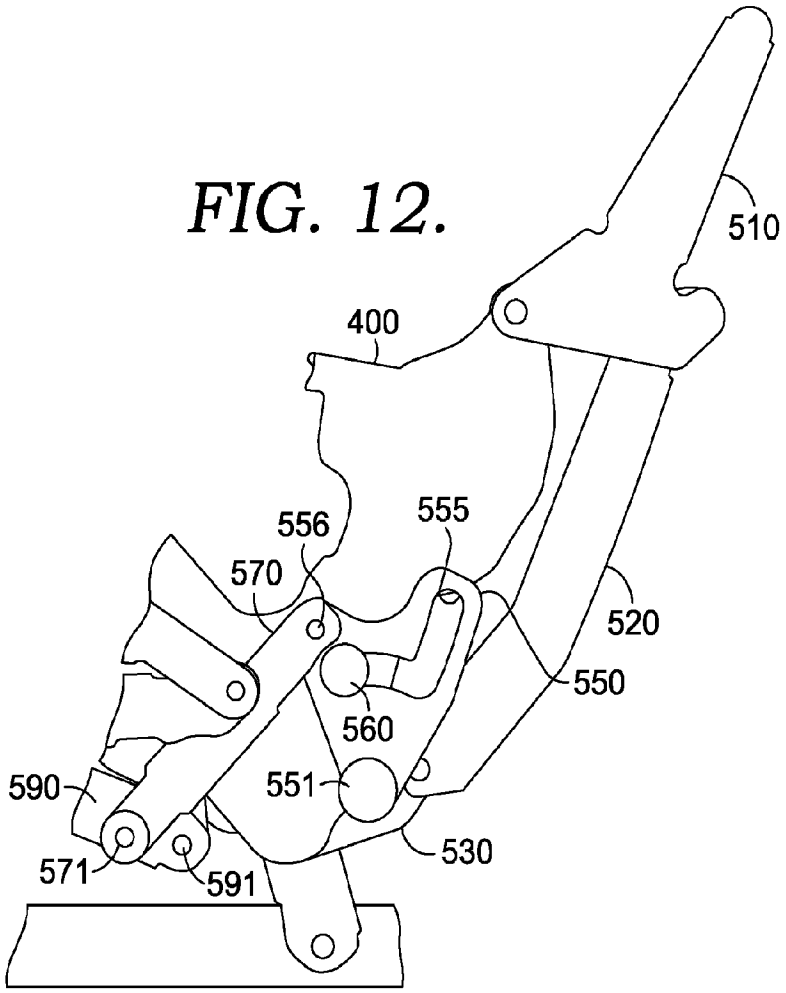
FIG. 12 is a partial side-elevation view of the linkage mechanism in the closed position highlighting a sequence plate, in accordance with an embodiment of the present invention.

Typically, the activator bar 350 is adapted to receive an occupant's actuation of adjustment between the closed position and the extended position. In particular embodiments, the activator bar 350 may be manually controlled (e.g., occupant may exert a manual rearward force on a hand-lever or may exert a force on a release lever of a cable actuator) or automatically controlled (e.g., occupant may trigger a control signal transmitted to a linear actuator 300), as more fully discussed below with reference to FIG. 8. Activator bar 350 is fixedly attached to the activator bracket 360 at an upper end thereof. A lower end of the activator bracket 360 is pivotably coupled, at pivot 365, to a rearward portion 372 of the footrest lock link 370, as best depicted in FIG. 11.

With reference to a manual-operated embodiment of the present invention, the inter-coupling of activator bracket 360 and the footrest lock link 370 converts a torque exerted by the occupant (rotational force) applied to the activator bar 350, into a forward and upward push (directional force) that acts on the pivot 111 of the footrest assembly 200. That is, a counterclockwise moment applied to the activator bar 350, with reference to FIG. 11, is transferred into an upward and forward translation of the footrest lock link 370 that initiates extension of the footrest assembly 200 from the closed position (FIGS. 1 and 7) to the extended position (FIGS. 2 and 6).

As discussed above, the pivot 111 couples a forward portion 371 of the footrest lock link 370 to the front ottoman link 110 of the footrest assembly 200. Unlike traditional 4-bar extension mechanisms, the upward and forward push is directed to the front ottoman link 110, as opposed to a rear ottoman link.

In operation, upon applying the forward and upward push (via the footrest lock link 370) that acts on the pivot 111, the front ottoman link 110 is rotated forward about the pivot 115 causing the footrest assembly 200 to extend. The forward rotation of the front ottoman link 110 affects forward rotation of the rear ottoman link 120 about the pivot 121. Generally, as a result of the configuration of the pivots 133 and 113, the front ottoman link 110 and the rear ottoman link 120 rotate in substantial parallel-spaced relation. The rotation of the front ottoman link 110 and the rear ottoman link 120 generate upward movement of the outer ottoman link 150 and the inner ottoman link 130, respectively. During their upward movements, the inner and outer ottoman links 130 and 150, respectively, operate in conjunction to raise and rotate the mid-ottoman bracket 140 and the footrest bracket 170 to generally horizontal orientations. Accordingly, the first foot-support ottoman 45 (see FIGS. 1-3), supported by the footrest bracket 170, and the second foot-support ottoman 47, supported by the mid-ottoman bracket 140, are movable from positions below the seat support surface to extended, horizontally-orientated positions. With reference to FIG. 8, retraction of the footrest assembly 200 is triggered by a counterclockwise moment at the activator bar 350 that pulls the footrest lock link 370 in a downward and rearward translation. Generally, in the motorized version, this downward and rearward translation invokes movement of the footrest mechanism 200 that is reverse to the steps discussed above with reference to the extension operation.

Turning to FIGS. 5-7, the additional components of the seat-mounting assembly 500 will now be discussed. Beginning at a rearward point of the seat-mounting assembly 500, the back-mounting link 510 is rotatably coupled to a rear portion 902 (see FIG. 9) of the seat-mounting plate 400 at pivot 401. In addition, the back-mounting link 510 is pivotably coupled to an upper portion 521 of the rear control link 520 at pivot 511. Rear control link 520 is pivotably coupled at the upper portion 521 to the back-mounting link 510 at the pivot 511 and is pivotably coupled at a lower portion 522 to the rear bellcrank 530 at pivot 525.

Rear bellcrank 530 includes an upper portion 536, a lower portion 537, and a forward portion 538. Rear bellcrank 530 is rotatably coupled at the lower portion 537 thereof to a mid portion 409 (see FIG. 9) of the seat-mounting plate 400 at pivot 536. Further, the rear bellcrank 530 is pivotably coupled at the lower portion 537 to the lower portion 522 of the rear control link 520 at pivot 525. In addition, the rear bellcrank 530 is pivotably coupled at the upper portion 536 to an upper portion 543 of the rear pivot link 540 at pivot 541. A lower portion 544 of the rear pivot link 540 is rotatably coupled to a back end 416 of the base plate 410 at pivot 542. Generally, this inter-coupling of the rear control link 520, the rear pivot link 540, and the rear bellcrank 530 is adapted to translate the seat-mounting plate 400 over the base plate 410 during adjustment between the closed position, the extended position, and the reclined position while maintaining the inclined orientation relationship therebetween. In an exemplary embodiment, the seat-mounting plate 400 may be biased at a substantially consistent inclination angle with respect to the base plate 410 throughout the adjustment between the closed position, the extended position, and the reclined position. Further, the inter-coupling of the rear control link 520, the rear pivot link 540, and the rear bellcrank 530 is adapted to recline the backrest 25 (see FIGS. 1-3) rearward while translating the seat-mounting plate 400 upward and forward over the base plate 410. Accordingly, the zero-wall clearance capability is achieved.

Rear bellcrank 530 includes a rear stop element 420 to prevent additional inclination of the back-mounting link 510 when the rear pivot link 540 makes contact therewith, as depicted in FIG. 7. As such, the location of the rear stop element 420 on the rear bellcrank 530 determines the extent of rearward bias allowed for the backrest and defines the configuration of the linkage mechanism 100 when adjusted to the closed position. Rear bellcrank 530 is also pivotably coupled at the forward portion 538 to a rearward portion 532 of the bridge link 535 at pivot 533. Bridge link 535 is pivotably coupled at a forward portion 531 to a mid portion 447 of the front lift link 440 at pivot 436.

In embodiments, the front lift link 440 includes a rearward portion 446, a forward portion 445, and the mid portion 447. As discussed above, the mid portion 447 of the front lift link 440 is pivotably coupled to the forward portion 531 of the front lift link 440 at pivot 436. Front lift link 440 is rotatably coupled at the rearward portion 446 to a forward portion 901 (see FIG. 9) of the seat-mounting plate at pivot 441. Additionally, the front lift link 440 is pivotably coupled at the forward portion 445 to an upper portion 456 of the front pivot link 450 at pivot 452. The front pivot link 450 is rotatably coupled at a lower portion 457 to a front end 415 (see FIG. 9) of the base plate 410 at pivot 453.

In instances of the present invention, the front pivot link 450 includes a mid portion 458 that is pivotably coupled to a lower portion 463 of the carrier link 460 at pivot 451. The carrier link 460 is pivotably coupled at an upper portion 464 to the front bellcrank 485 at pivot 461. Typically, the front bellcrank 485 includes an upper portion 481, a lower portion 483, and a mid portion 482, as illustrated at FIG. 7. The upper portion 481 of the front bellcrank 485 is pivotably coupled to the carrier link 460 at pivot 461, as discussed immediately above. Pivot 487 at the mid portion 482 of the front bellcrank 485 rotatably couples the front bellcrank 485 to the mid portion 409 (see FIG. 9) of the seat-mounting plate 400. The lower portion 483 of the front bellcrank 485 is pivotably coupled to a back end 591 of the footrest drive link 590 at pivot 486. A front end 592 of the footrest drive link 590 is pivotably coupled to the rear ottoman link 120 of the footrest assembly 200 at the pivot 125.

With continued reference to FIGS. 4-7, the operation of the seat-adjustment assembly 500 will be discussed, in accordance with an embodiment of the present invention. Initially, an operator-initiated, rearward occupant force may be received at the backrest. As discussed above, the back-mounting link 510, in cooperation with a complimentary back-mounting link of the mirror-image linkage mechanism, serve to support the backrest (see reference numeral 25 of FIGS. 1-3) of the seating unit. In one embodiment of a manually adjustable seating unit, the occupant's rearward force directed at the backrest should overcome a balance threshold in order to rearwardly bias the back-mounting link 510, thereby enabling movement from the extended position (FIG. 6) to the reclined position (FIG. 5). Essentially, the balance threshold may be defined by a ratio of the rearward occupant force on the backrest and the downward occupant weight on the seat. In operation, the downward force of the occupant's weight pushes the seat-mounting plate 400 downward, while the occupant's rearward force on the backrest pushes the seat-mounting plate 400 upward via the inter-coupling of the back-mounting link 510, the rear control link 520, the rear bellcrank 530, the rear pivot link 540, and the base plate 410. (It should be noted that the balance threshold is applicable in a manual-adjustment style seating unit, while an automated-adjustment style seating unit relies on a motor or other linear actuator to adjust the linkage mechanism 200 between the extended and reclined positions.) As such, the rearward force competes against the downward force to invoke adjustment of the seating unit.

Once the occupant overcomes the balance threshold by counteracting his/her weight in the seat by exerting sufficient rearward force, or leaning backward on the backrest, rearward rotation of the back-mounting link 510 (clockwise rotation from the perspective of FIG. 5) is enabled about the pivot 401 and adjustment from the reclined position to the extended position commences. The rearward rotation generates a torque about the pivot 511. The torque is converted to a laterally-directed force through the rear control link 520. Consequently, the rear control link 520 transfers the laterally-directed force between the back-mounting link 510 and the rear bellcrank 530. Typically, the rear control link 520 creates a clockwise torque on the rear bellcrank 530 about the pivot 536. Rear bellcrank 530 converts the clockwise torque to a downward force directed through the rear pivot link 540, which rotates about the back end 416 of the base plate 410 at pivot 542.

This rotation enables the seat-mounting plate 400 to be translated forward and upward in relation to the base plate 410 during adjustment from the extended position to the reclined position. In embodiments, the links 510, 520, and 540, as well as the rear bellcrank 530, are designed to translate the seat-mounting plate 400 such that the seat remains biased in a substantially consistent inclination angle with respect to the base plate 410 throughout adjustment. Further, the links 510, 520, and 540, as well as the rear bellcrank 530, are designed to translate the seat-mounting plate 400 forward at a greater rate than the rearward rotation of the back-mounting link 510, thus, achieving zero-wall clearance.

The forward translation of the seat-mounting plate 400 is additionally affected by the links 535, 440, and 450. As viewed in FIGS. 4 and 5, in a particular embodiment, the clockwise torque (imposed by the occupant) on the rear bellcrank 530 about the pivot 536 generates a laterally-directed force on the bridge link 535 that acts to pull the front lift link 440 rearward. This rearward pull creates a counterclockwise rotation of the front lift link 440 about the pivot 441, which rotatably couples the front lift link 440 to the seat-mounting-plate 400. This counterclockwise rotation is eventually impeded by an interior mid stop element 421. When the front lift link 440 contacts the interior mid stop element 421, full adjustment to the reclined position is achieved. The counterclockwise rotation of the front lift link 440 also creates a laterally-directed force through the front pivot link 450 onto the front end 415 of the base plate 410. The laterally-directed force causes the front pivot link 450 to swing forward about pivot 453, thereby enabling forward translation of the seat-mounting plate 400 with respect to the base plate 410.

Upon relieving the rearward occupant force on the backrest below the balance threshold (e.g., by the occupant leaning forward), the back-mounting link 510 is allowed to forwardly bias. In particular, the downward occupant weight allows the rear pivot link 540 to push upward on the rear bellcrank 530 creating counterclockwise rotation thereof. The counterclockwise rotation transfers a laterally-directed force through the rear control link 520 that acts to rotate the back-mounting link 510 in a counterclockwise manner. That is, the laterally-directed force applied by the rear control link 520 enables moving the back-mounting link 510 forward to a substantially upright orientation. In one instance, a stop element (not shown) extending from the rear bellcrank 530 resists continued rotation thereof, upon contacting the seat-mounting plate 400; thus, further forward inclination of the backrest when in the closed or the extended position is contained.

Referring to FIG. 8, an automated version of the linkage mechanism 100 is illustrated, and will now be described via the embodiments below. The automated version may involve a linear actuator 300 that includes an angle bracket 315 fixed to the activator bar 350 (discussed above), a motor mechanism 320, a track 330 that interconnects the motor mechanism 320 and a motor activator block 340, the motor activator block 340, a right motor link 380, and a left motor link 390, which resides in substantially parallel-spaced relation to the right motor link 380. Further, a support assembly 600 may be provided that serves as a foundation that rests on a surface underlying the seating unit.

Figure 15:
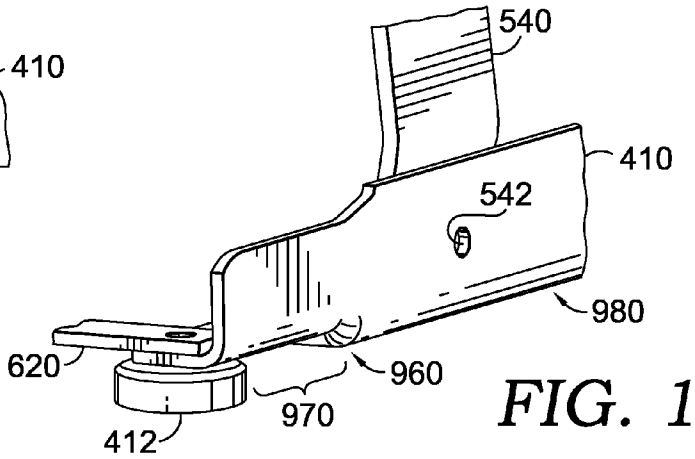
FIG. 15 is a diagrammatic perspective view of a based plate exhibiting a formed step on one end, in accordance with an embodiment of the present invention.
Figure 14:
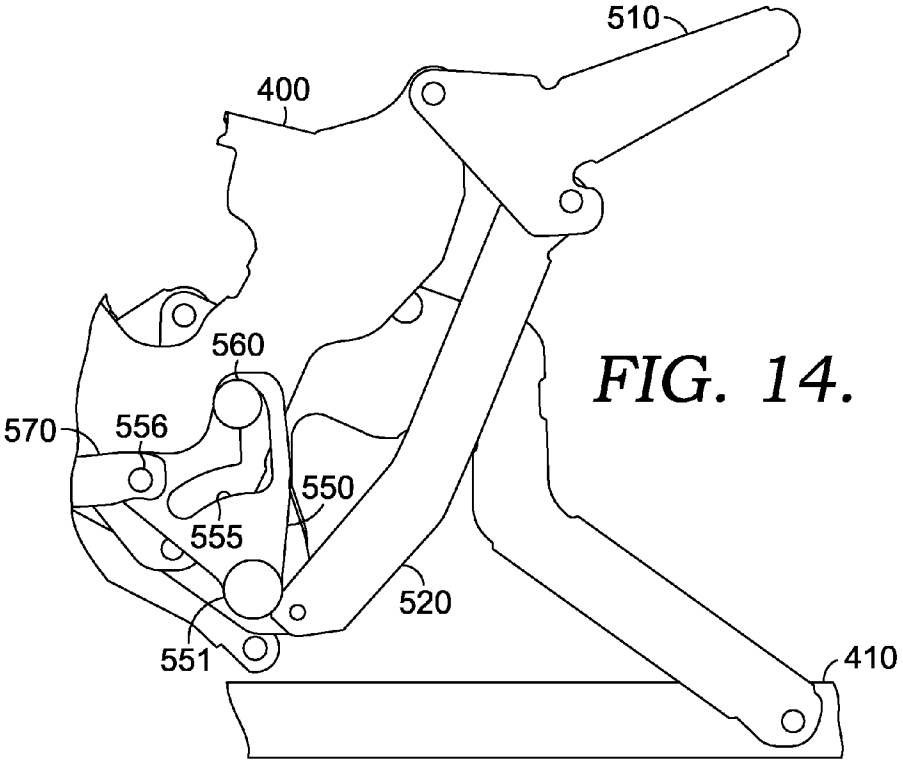
FIG. 14 is a view similar to FIG. 12, but in the reclined position, in accordance with an embodiment of the present invention.

In particular, the support assembly 600 may serve to accommodate the linear actuator 300. The support assembly 600 depicted in FIG. 8 includes a front lateral member 610 and a rear lateral member 620, which resides in substantially parallel-spaced relation to the front lateral member 610. The lateral members 610 and 620 function to support the linear actuator 300 and the base plates 410 above an underlying surface. The support bushings 411 and 412 of FIGS. 5 and 15 are provided to raise the linear actuator 300 and the base plates 410 to a specific level above the underlying surface.

In embodiments, the lateral members 610 and 620 function as crossbeams that span between the base plate 410 of the linkage mechanism 100 and a complimentary base plate incorporated within a mirror-image linkage mechanism that is disposed in substantial parallel-spaced relation to the linkage mechanism 100. Further, the lateral members 610 and 620 may be formed from metal stock. Similarly, the seat-mounting plate 400, base plate 410, and the plurality of links that comprise the linkage mechanism 100 are typically formed from metal stock, such as stamped, formed steel. However, it should be understood and appreciated that any suitable rigid or sturdy material known in the furniture-manufacturing industry may be used in place of the materials described above.

In embodiments of the linear actuator 300, the motor mechanism 320 is protected by a housing that is coupled, or fixedly attached, to the front lateral member 610. The motor mechanism 320 is operably coupled to a forward end of the track 330. A rearward end of the track 330 is coupled, or fixedly attached, to the rear lateral member 620. The track 330 includes a first travel section 331 and a second travel section 332. The motor activator block 340 is configured to translate longitudinally, or slidably engaged, along the track 330 under automated control of the motor mechanism 320. Right motor link 380 and the left motor link 390 are pivotably coupled to the motor activator block 340, and are pivotably coupled to protrusions extending from the angle bracket 315.

As discussed above, the linkage mechanism 100 is coupled to the linear actuator 300, which provides powered adjustment of the linkage mechanism 100 between the reclined, the extended, and the closed positions. In an exemplary embodiment, the motor activator block 340 travels towards or away from the motor mechanism 320 along the track 330 during automated adjustment of the linkage mechanism 100. In a particular embodiment, the motor mechanism 320 controls movement of the motor activator block 340 along the travel sections 331 and 332 of the track 330.

In operation, a control signal from the occupant of the seating unit, or elsewhere, may trigger the motor mechanism 320 to invoke longitudinal translation of the motor activator block 340, which, in turn, generates movement of the linkage mechanism 100. As more fully discussed below, the sliding action is sequenced into a first phase and a second phase. During the first phase, the motor mechanism 320 moves the motor activator block 340 forward with respect to the motor mechanism 320, while the motor mechanism 320 remains generally fixed in space, thereby adjusting the seat-adjustment assembly 500 from the closed position (FIG. 7) to the extended position (FIG. 6).

Adjustment within the first phase involves causing the motor activator block 340 to longitudinally traverse, or slide, along the first travel section 331 of the track 330. This traverse of the motor activator block 340 within the first travel section 331 generates a forward and upward thrust at the motor links 380 and 390 that pushes on the angle bracket 315, thereby rotatably adjusting the activator bar 350. As discussed above, the rotatable adjustment of the activator bar 350 controls adjustment of the seating unit between the closed position and the extended position (i.e., extending the footrest assembly 200).

Once a stroke of the first phase is substantially complete, the second phase occurs. During the second phase, the motor activator block 340 moves forward again with respect to the motor mechanism 320, while the motor mechanism 320 remains generally fixed in space. In embodiments, adjustment within the second phase involves causing the motor activator block 340 to longitudinally traverse along the second travel section 332 of the track 330. This traverse of the motor activator block 340 within the second travel section 332 generates a forward and upward thrust at the motor links 380 and 390 that pushes on the angle bracket 315, thereby translating the activator bar 350 forward and upward with respected to the base plate 410. This translation of the activator bar 350 controls adjustment of the seating unit between the extended position and the reclined position (i.e., initiating adjustment of the seat-adjustment assembly 500 without the assistance of an occupant's rearward force on the backrest).

In one instance, the combination of the motor mechanism 320, the track 330, and the motor activator block 340 is embodied as the "electrically powered" linear actuator 300. In this instance, the linear actuator 300 is controlled by a hand-operated controller that provides instructions thereto. These instructions may be provided upon detecting a user-initiated actuation of the hand-operated controller. Further, these instructions may cause the linear actuator 300 to carry out a compete first phase and/or second phase of movement (discussed below). Or, the instructions may cause the linear actuator 300 to partially complete the first phase or the second phase of movement. As such, the linear actuator 300 may be capable of being moved to and maintained at various positions within a stroke of the first phase or the second phase, in an independent manner.

Although a particular configuration of the combination of the motor mechanism 320, the track 330, and the motor activator block 340 has been described, it should be understood and appreciated that other types of suitable devices that provide sequenced adjustment may be used, and that embodiments of the present invention are not limited to the linear actuator 300 as described herein. For instance, the combination of the motor mechanism 320, the track 330, and the motor activator block 340 may be embodied as a telescoping apparatus that extends and retracts in a sequenced manner.

Figure 9:
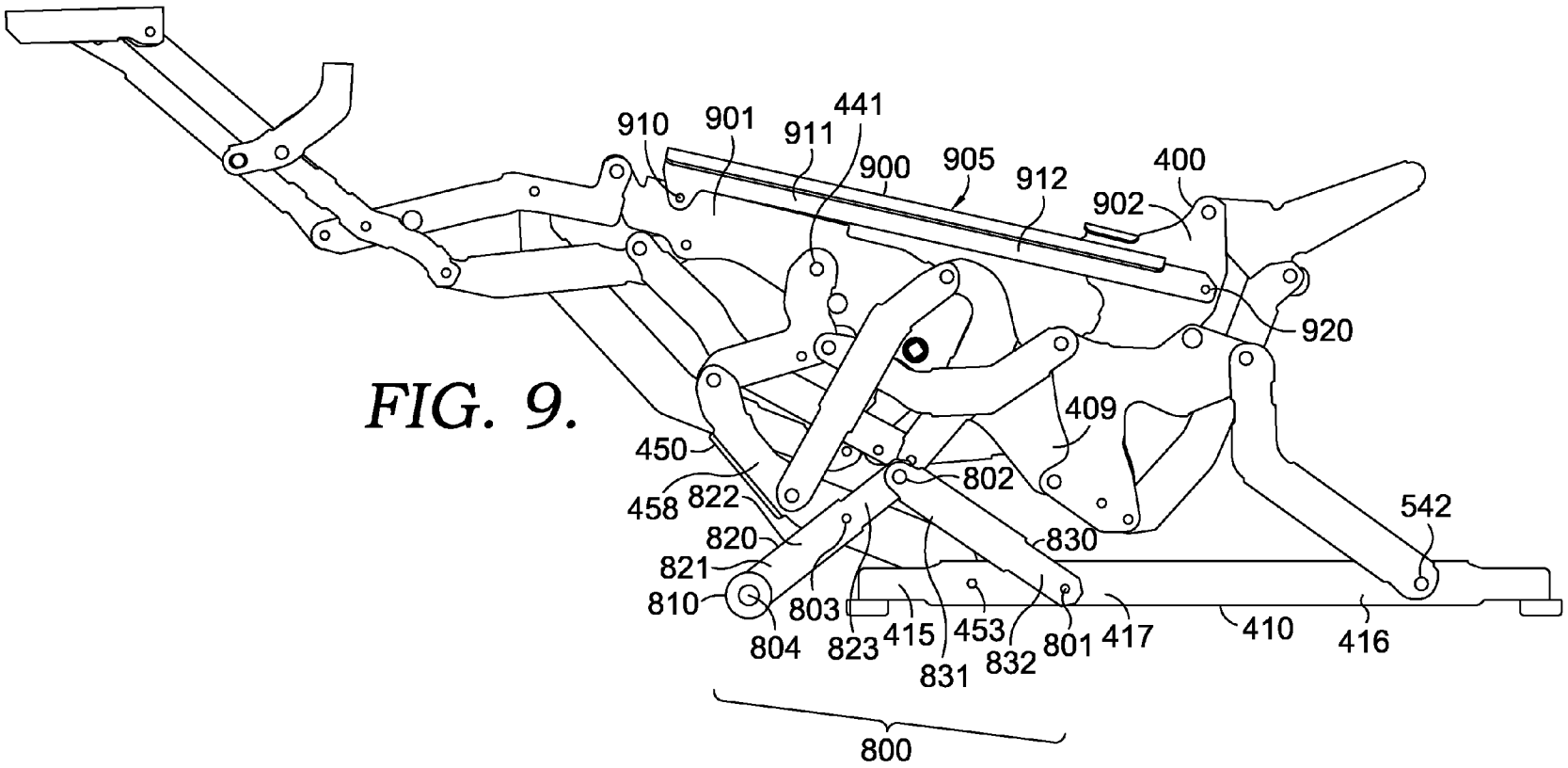
FIG. 9 is a diagrammatic lateral view of the linkage mechanism with motorized adjustment in the reclined position with an anti-tipping mechanism extended, in accordance with an embodiment of the present invention.

Referring to FIGS. 8 and 9, embodiments of the seat-mounting plate 400 will now be described. In one instance, the seat-mounting plate 400 is provided with a forward tab, indicated by reference numeral 406 and a rearward tab (not shown). These tabs are typically formed into an upper portion of the seat-mounting plate 400 to hold the seat (see reference numeral 15 of FIGS. 1-3). By way of example, the seat tabs may be formed in substantially perpendicular relation to the remainder of the seat-mounting plate 400. As such, the tabs of the seat-mounting plate 400, in conjunction with similarly configured tabs of a complimentary seat-mounting plate residing in substantial parallel-spaced relation with the seat-mounting plate 400, define the seating support surface that extends between the seat-mounting plates.

In an exemplary embodiment, the seat-mounting plate 400 and the complimentary seat-mounting plate each include a one-piece seat guard 905 fixedly attached thereto. Generally, the seat guard 905 spans a length of the seating support surface described above. As illustrated in FIG. 9, the seat guard 905 includes a front end 911 and a back end 912. The seat guard 905 may be fixedly attached at the front end 911 to the forward portion 901 of the seat-mounting plate 400, at 910, and may be fixedly attached at the back end 912 to the rear portion 902 of the seat-mounting plate 400, at 920. In operation, the seat guard 905 prevents links of the linkage mechanism 100 from cutting into foam, webbing, or other material that comprises the seat of the seating unit.

Figure 10:
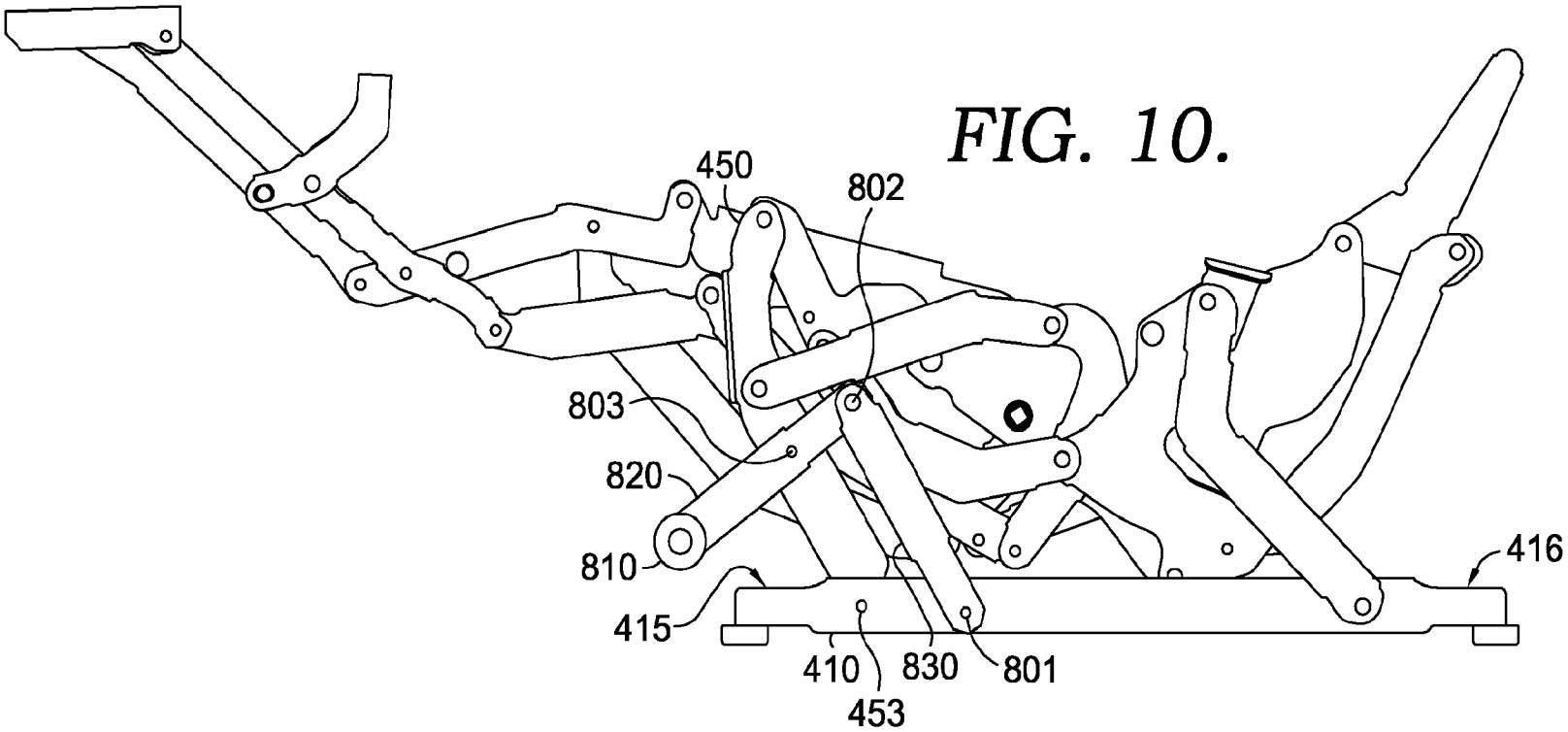
FIG. 10 is a view similar to FIG. 9, but in the extended position with the anti-tipping mechanism retracted, in accordance with an embodiment of the present invention.

Referring to FIGS. 9 and 10, the configuration and operation of an anti-tipping mechanism 800 will now be discussed. Initially, the anti-tipping mechanism 800 is typically installed on automated versions of the present invention (e.g., including the linear actuator 300) in order to prevent the seating unit from tipping forward when adjusted to the reclined position. The manually adjustable linkage mechanisms 100 of FIGS. 1-7 will naturally adjust from the reclined position to the extended position when the occupant of the seating unit leans forward and satisfies the balance threshold (described above). However, the automated versions remain statically fixed in the reclined position upon the occupant leaning forward. This shift in occupant weight, combined with the forwardly displaced weight of the extended footrest assembly 200, potentially unbalances the seating unit inducing it to tip forward. Accordingly, the anti-tipping mechanism 800 extends forward in the reclined position to provide additional stabilization to the unbalanced seating unit.

Generally, the anti-tipping mechanism 800 includes a contact element 810, a rearward member 830 that has an upper end 831 and a lower end 832, and a forward member 820 that has an upper end 823, a lower end 821, and a mid section 822. The lower end 832 of the rearward member 830 is rotatably coupled to a mid portion 417 of the base plate 410 at pivot 801. The upper end 831 of the rearward member 830 is pivotably coupled to the upper end 823 of the forward member 820 at pivot 802. The mid section 822 of the of the forward member 820 is pivotably coupled to the mid portion 458 of the front pivot link 450 at pivot 803. The lower end 821 of the forward member 820 is coupled to the contact element 810 at pivot 804. As used herein, the phrase "contact element" 810 may generally refer to any component capable of withstanding repeated contact with the underlying surface and configured with sufficient rigidity to promote stability of the seating unit (e.g., plastic roller, rubber pad, and the like).

In operation, the anti-tipping mechanism 300 extends the contact element 810 forward and downward towards the underlying surface (not shown) when the linkage mechanism 100 is adjusted to the reclined position (see FIG. 9). That is, the forward swing of the front pivot link 450 about the pivot 453, when adjusting to the reclined position, extends the forward member 820, such that the members 820 and 830 form an obtuse angle. In a contrary fashion, the anti-tipping mechanism 800 retracts the contact element 810 away from the underlying surface when the linkage mechanism 100 is adjusted from the reclined position (see FIG. 10). That is, the rearward swing of the front pivot link 450, when adjusting to the extended position, retracts the forward member 820, such that the members 820 and 830 form an acute angle.

Turning to FIGS. 11-14 and 16, a configuration of a sequence plate 550, a sequence element 560, and a front sequence link 570 will now be discussed. As with the anti-tipping mechanism 800, the components 550, 560, and 570 are typically installed on the automated version of the linkage mechanism 100. One reason for installing the components 550, 560, and 570 on the automated version is to correct for the case where the weight of the legs of the occupant of the seating unit causes the seat to raise and/or the backrest to recline out of sequence (i.e., prior to fully achieving adjustment to the extended position).

Figure 16:
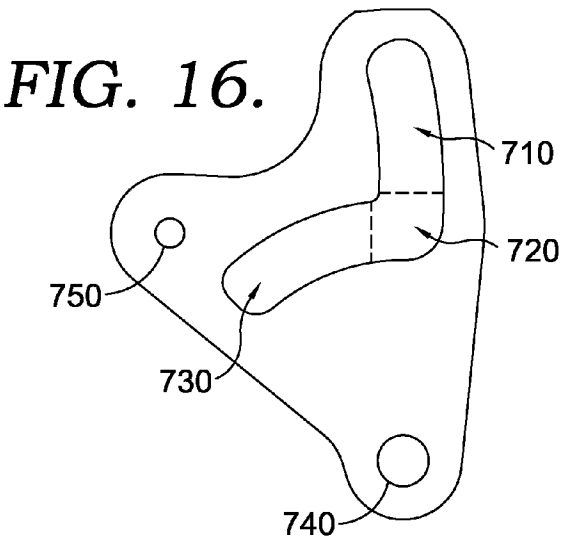
FIG. 16 is a diagrammatic lateral view of the sequence plate disassembled from the linkage mechanism, in accordance with an embodiment of the present invention.

As illustrated in FIGS. 11 and 16, the sequence plate 550 includes a guide slot 555, an aperture 740 for receiving hardware to form pivot 551, and an aperture 750 for receiving hardware to form pivot 556. The guide slot 555 is machined or formed within the sequence plate 550 and includes a first region 710, a second region 730, and an intermediate region 720 that interconnects the first region 710 and the second region 730. In embodiments, the guide slot 555 is generally L-shaped and the first region 710 is substantially vertical while the second region 730 is substantially horizontal.

The sequence plate 550 is rotatably coupled to an exterior side of the seat-mounting plate 400. In one instance, the rotatable coupling occurs at the pivot 551, which is located at the mid portion 409 (see FIG. 9) of the seat-mounting plate 400. A rearward end of the front sequence link 570 is pivotably coupled to the sequence plate 550 at the pivot 556. A forward end of the front sequence link 570 is pivotably coupled to the back end 591 (see FIG. 6) of the footrest drive link 590 at pivot 571. As such, adjustment of the footrest drive link 590 between the closed position (see FIG. 12) and extended position (see FIG. 13) may, in turn, articulably actuate the front sequence link 570 laterally. This lateral actuation causes the sequence plate 550 to rotate forward and backward about the pivot 551. Consequently, the rotation of the sequence plate 550 changes a relative position of the sequence element 560 within the guide slot 555.

Typically, the sequence element 560 is configured as a bushing or cylindrically shaped element that can effortlessly ride or travel within the guide slot 555. The sequence element 560 is fixedly attached to the mid portion 409 of the seat-mounting plate 400 on the exterior side, which is the side opposed to the rear bellcrank 530. Generally, the sequence element 560, at least partially, extends into the guide slot 555.

In a particular embodiment, the sequence element 560 fully extends through the guide slot 555 and includes a cap (not shown) that retains the sequence plate 550 onto the sequence element 560.

The interaction between the components 550, 560, and 570 will now be discussed. Initially, the sequence element 560 resides within the second region 730 when the seating unit is adjusted to the closed position (see FIG. 12). When captured within the second region 730 of the guide slot 555, the interaction between the sequence element 560 and the sequence plate 550 resists adjustment of the seating unit to the reclined position. However, when the seating unit is adjusted to the extended position (see FIG. 13), by forwardly actuating the front sequence link 570 as discussed above, the sequence element 560 is shifted to reside within the intermediate region 720, or elbow, of the guide slot 555. When residing in the intermediate region 720, the seating unit is free to be adjusted to either the closed position or the reclined position, as the guide slot 555 allows two-directions of movement of the sequence element 560 from the intermediate region 720.

The seating unit may then be adjusted from the extended position to the reclined position (see FIG. 14) via manual or automated control. This adjustment causes the seat-mounting plate 400 to lower and to shift the sequence element 560 to reside within the first region 710. When the sequence element 560 resides within the first region 710 of the guide slot 555, the interaction of the sequence element 560 and the sequence plate 555 resists adjustment of the seating unit to the closed position. Accordingly, the sequencing described above ensures that adjustment of the footrest assembly 200 between the closed and extended positions is not interrupted by rotational biasing of the backrest, or vice versa. In other embodiments, the weight of the occupant of the seating unit and/or springs interconnecting links of the seat-adjustment assembly 500 assist in creating or enhancing the sequencing.

Referring to FIG. 15, an exemplary configuration of the base plate 410 will now be described. Initially, the base plate 410 includes the front end 415 and the back end 416 (see FIG. 9). Further, a substantially perpendicular bend 980 may constitute a lower edge of the base plate 410. In an exemplary embodiment, the base plate 410 has a step 960 formed into the bend 980 at the lower edges thereof. The formed step 960 may be located at the front end 415 of the base plate 410 (not shown), the back end 416 of the base plate 410 (see FIG. 15), or both. As illustrated in FIG. 15, the formed step 960 may provide a raised section 970 that fixedly attaches to one of the lateral members 610 or 620 that serve as crossbeams spanning the base plates.

Further, the raised section 970 may compensate for a height of the support bushings 411 and 412, thereby allowing a majority of the bend 980 of the base plate 410 to reside at a level below a top of the support bushings 411 and 412. In this way, the links of the linkage mechanism 100 may be designed to be longer and cover a wider throw (greater swing-range) when pivoting. These features of longer length and wider throw are beneficial in accomplishing more movement of the seat-mounting plate 400 and gaining more wall clearance during recline of the backrest. Also, the formed step 960 provides structural support and reinforcement to the ends 415 and 416 of the base plate 410, thus, allowing the base plate 410 to be fabricated from a thinner plate. In practice, the reinforced ends 415 and 416 of the base plate 410 resist bending, deformation, or other damage that results from dropping during transport or caused by other common abuse when handling.

It should be understood that the construction of the linkage mechanism 100 lends itself to enable the various links and brackets to be easily assembled and disassembled from the remaining components of the seating unit. Specifically the nature of the pivots and/or mounting locations, allows for use of quick-disconnect hardware, such as a knock-down fastener. Accordingly, rapid disconnection of components prior to shipping, or rapid connection in receipt, is facilitated.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A mechanism providing recline and footrest extension for a seating unit, the mechanism comprising:

a base plate;

a seat-mounting plate spaced apart from the base plate;

a linkage mechanism that moveably interconnects the base plate and the seat-mounting plate and that includes:

a back-mounting link that supports a backrest, wherein the back-mounting link is rotatably coupled to the seat-mounting plate;

a rear control link that is pivotably coupled to the back-mounting link;

a rear pivot link that is rotatably coupled at a first end directly to the base plate; and a rear bellcrank that is rotatably coupled to the seat-mounting plate and is pivotably coupled to the rear control link and to a second end of the rear pivot link that opposes the first end, wherein the inter-coupling of the rear control link, the rear pivot link, and the rear bellcrank is adapted to translate the seat-mounting plate over the base plate during adjustment between a closed position, an extended position, and a reclined position.

2. The mechanism of claim 1, wherein the rear bellcrank includes an upper portion, a lower portion, and a forward portion, and wherein the rear bellcrank is rotatably coupled at the lower portion thereof to the seat-mounting plate.

3. The mechanism of claim 2, wherein the rear control link includes an upper portion and a lower portion, wherein the rear control link is pivotably coupled at the upper portion thereof to the back-mounting link, and wherein the rear control link is pivotably coupled at the lower portion thereof to the lower portion of the rear bellcrank.

4. The mechanism of claim 2, wherein the rear pivot link includes an upper portion and a lower portion, wherein the rear pivot link is pivotably coupled at the upper portion thereof to the upper portion of the rear bellcrank, and wherein the rear pivot link is pivotably coupled at the lower portion thereof to the base plate.

5. The mechanism of claim 2, wherein the linkage mechanism further comprises:

a bridge link having a forward portion and a rearward portion, which is pivotably coupled to the forward portion of the rear bellcrank;

a front lift link having a rearward portion, a forward portion, and a mid portion, wherein the forward portion of the bridge link is pivotably coupled to the mid portion of the front lift link and wherein the front lift link is rotatably coupled at the rearward portion thereof to the seat-mounting plate; and a front pivot link having an upper portion and a lower portion, wherein the upper portion of the front pivot link is pivotably coupled to the forward portion of the front lift link and wherein the lower portion of the front pivot link is rotatably coupled to the base plate.

6. The mechanism of claim 1 further comprising, an activator bracket that is attachable to an activator tube;

a footrest lock link that is pivotably attached to the activator bracket; and a footrest assembly that is attached to the footrest lock link, wherein the footrest assembly includes a front ottoman link and a rear ottoman link that are attached to the seat plate and wherein the footrest lock link is pivotably attached to the front ottoman link.

7. A mechanism providing recline and footrest extension for a seating unit, the mechanism comprising:

a base plate;

a seat-mounting plate spaced apart from the base plate;

a linkage mechanism that moveably interconnects the base plate and the seat-mounting plate and that includes:

a front bellcrank that includes an upper portion, a lower portion, and a mid portion that is rotatably coupled to the seat-mounting plate;

a carrier link having an upper portion and a lower portion, the upper portion being pivotably coupled to the upper portion of the front bellcrank; and a front pivot link having an upper portion, lower portion, and a mid portion, wherein the mid portion of the front pivot link is rotatably coupled to the lower portion of the carrier link, and wherein the lower portion of the front pivot link is pivotably coupled to the base plate.

8. A seating unit having a chassis, a seat, a backrest, and at least one foot-support ottoman, the seating unit being adapted to move between a closed, an extended and a reclined position, the seating unit comprising:

a pair of base plates in substantially parallel-spaced relation, wherein the base plates are mounted to the chassis and are vertically raised above an underlying surface by a plurality of supports;

a pair of seat-mounting plates in substantially parallel-spaced relation, wherein the seat-mounting plates translatably carry the seat over the base plates; and a pair of the generally mirror-image linkage mechanisms each moveably interconnecting each of the base plates to a respective seat-mounting plate, wherein each of the linkage mechanisms comprise:

(a) a front bellcrank that includes an upper portion, a lower portion, and a mid portion that is rotatably coupled to a respective seat-mounting plate;

(b) a carrier link having an upper portion and a lower portion, the upper portion being pivotably coupled to the upper portion of the front bellcrank; and (c) a front pivot link having an upper portion, lower portion, and a mid portion, wherein the mid portion of the front pivot link is rotatably coupled to the lower portion of the carrier link, and wherein the lower portion of the front pivot link is pivotably coupled to a respective base plate;

(d) a footrest drive link that includes a front end and a back end that is pivotably coupled to the lower portion of the front bellcrank;

(e) a footrest assembly adapted to extend the at least one foot-support ottoman forward, with respect to the base plates, when adjusting from the closed position to the extended position, the footrest assemblies comprising:

(f) an ottoman link rotatably coupled to a respective seat-mounting link and pivotably coupled to the front end of the footrest drive link;

(g) a front ottoman link rotatably coupled to the respective seat-mounting link in a forward location of the rotatable coupling of the rear ottoman link;

(h) an activator bracket rotatably coupled at a first end to a respective seat-mounting plate via an activator bar; and (i) a footrest lock link having a forward portion and a rearward portion, wherein the rearward portion of the footrest lock link is pivotably coupled to a second end of the activator bracket, and wherein the forward portion of the footrest lock link is pivotably coupled to the front ottoman link.

9. The seating unit of claim 8, wherein the activator bar is adapted to receive an occupant's actuation of adjustment from the closed position to the extended position, wherein the activator bracket is adapted to convert the actuation to a forward and upward translation of the footrest drive link, and wherein the footrest drive link is drivably coupled to the footrest assembly such that the forward and the upward translation of the footrest drive link initiates movement of a footrest assembly from the closed position to the extended position.

10. The seating unit of claim 9, wherein, incident to the forward and the upward translation of the footrest drive link, a downward occupant weight on the seat is converted by the front bellcrank to a forward translation of the footrest drive link, thereby facilitating movement of the footrest assembly from the closed position to the extended position.

11. The seating unit of claim 8, further comprising a linear actuator, wherein the linear actuation includes:

a motor mechanism;

a track operably coupled to the motor mechanism, wherein the track includes a first travel section and a second travel section; and a motor activator block that translates longitudinally along the track under automated control, wherein the motor activator block is pivotably coupled to one or more motor links, wherein longitudinal translation of the motor activator block along the first travel section creates a torque at the one or more motor links thereby rotatably adjusting the activator bar, the rotatable adjustment of the activator bar controls adjustment of the seating unit between the closed position and the extended position, and wherein longitudinal translation of the motor activator block along the second travel section creates a lateral thrust at the one or more motor links thereby translating the activator bar, the translation of the activator bar controls adjustment of the seating unit between the extended position and the reclined position.

12. The seating unit of claim 11, further comprising a linear actuator, wherein the linear actuation includes:

a rear lateral member interconnecting the pair of base plates, wherein the track is attached to the rear lateral member; and a front lateral member interconnection the pair of base plates in substantially parallel-spaced relation to the rear lateral member, wherein the motor mechanism is attached to the front lateral member.

* * * * *